United States Patent [19]

Blando

[11] Patent Number: 4,548,017

[45] Date of Patent: Oct. 22, 1985

[54] BUILDING PANEL

[75] Inventor: Jack Blando, Brooklyn, N.Y.

[73] Assignee: Liverpool Industries, Inc., Brooklyn, N.Y.

[21] Appl. No.: 573,148

[22] Filed: Jan. 23, 1984

[51] Int. Cl.[4] ..... E04C 2/32

[52] U.S. Cl. ..... 52/814; 52/827

[58] Field of Search ..... 52/814, 827, 821, 53, 52/54, 795; 405/282, 151

[56] References Cited

U.S. PATENT DOCUMENTS 1,601,630 9/1926 Lesoine et al. ..... 52/814

3,481,643 12/1969 Campbell ..... 52/814 X 4,030,246 6/1977 Naylor ..... 52/814 X

*Primary Examiner*—Carl D. Friedman

*Attorney, Agent, or Firm*—Ronald R. Santucci

[57] ABSTRACT

A building panel fabricated out of metal including a generally flat sheet having a plurality of parallel raised ribs which traverse a portion of its width. Side beams are provided at the ends of the ribs and affixed thereto with an elongated portion thereof resting over and affixed to the area between the rib end and the end of the panel. A center beam is located between the side beams and is affixed to the ribs with mounting openings located at points of respective overlap of the side and center beams and the ribs.

8 Claims, 4 Drawing Figures

FIG. 2
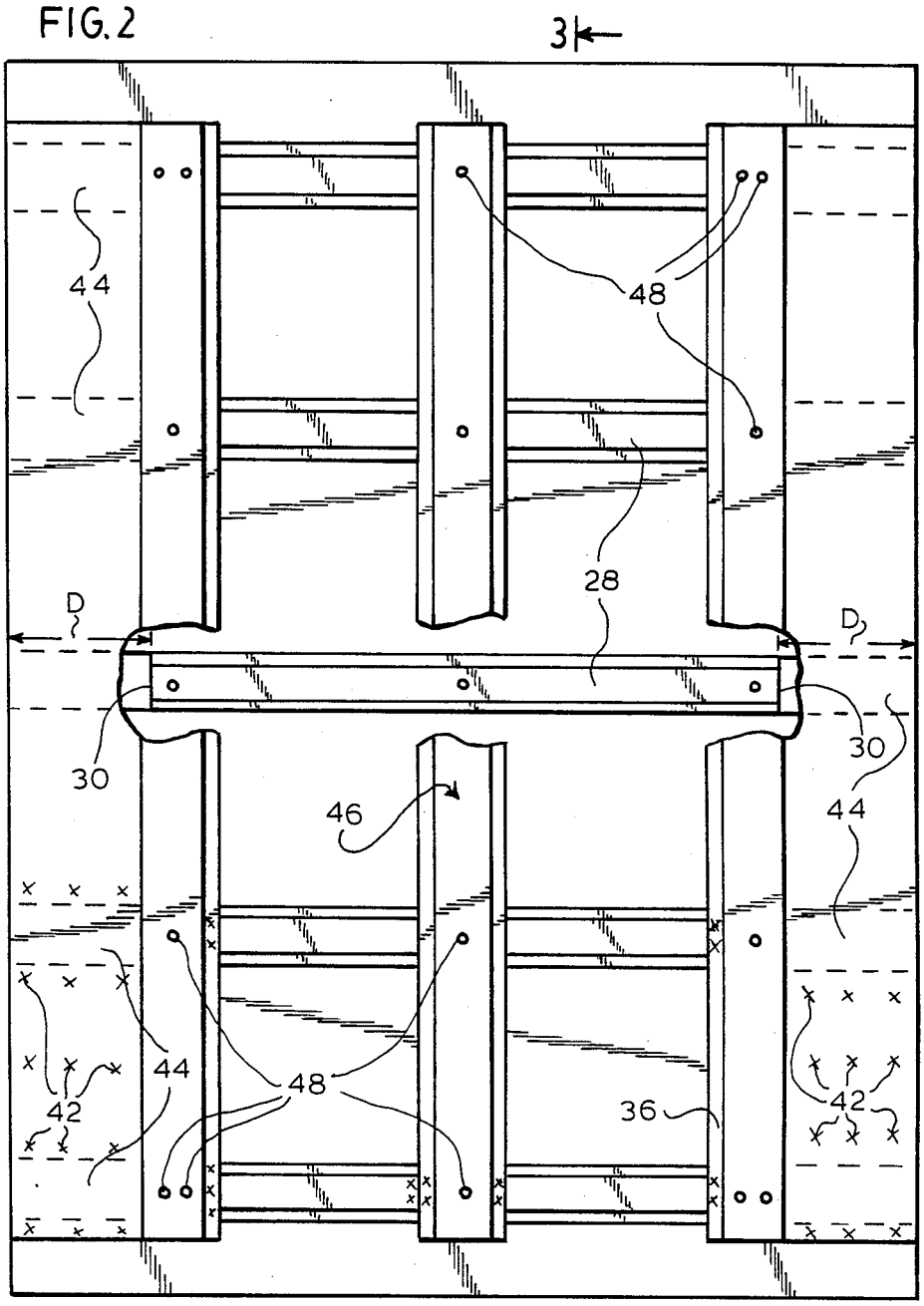
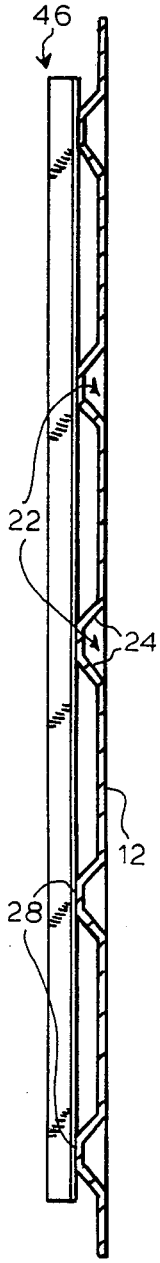
FIG. 3
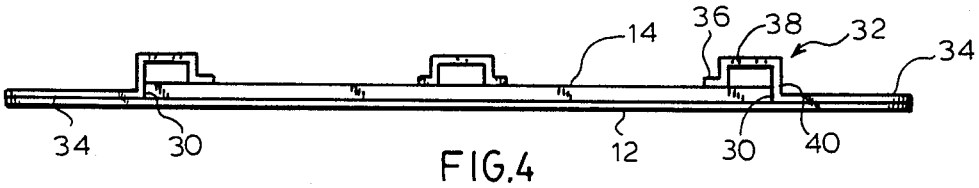
FIG. 4

BUILDING PANEL

FIELD OF THE INVENTION

The present invention is directed towards a panel, particularly a building panel for use in ceiling and wall construction.

BACKGROUND OF THE INVENTION

There presently exists a variety of forms of building panels used for many functions. In certain applications, it is desirous to provide a panel which is durable and readily implemented to serve as a ceiling or protective barrier between or about an area and the surface in or on which it is positioned. An example of this is particularly apparent in heavy construction where it is necessary to prevent the ingress of retained material into the area protected such as tunnels, sidewalk overheads during building construction etc. Heretofore, an often used panel was of a flat sheet or perhaps corregated metal. However, in many applications including those forementioned, it has become desirable to provide a more durable panel which is asthetically pleasing, durable, versatile and yet easily mounted.

SUMMARY OF THE INVENTION

It is a principal object of the present invention to provide a building panel which is versatile to allow widespread application.

It is a further object of the invention to provide for a building panel which is readily mounted in a variety of situations.

A yet further object is to provide a building panel which provides for relative ease in fabrication and construction.

Another object is to provide a panel which is asthetically pleasing yet durable.

The present invention provides for a building panel which is preferably fabricated out of metal, particularly for example stainless steel for durability and strength. The panel includes a sheet which is rectangular in shape and particularly suited for mounting adjacent similar panels. Rather than being a single flat panel or corregated, it is formed with a series of parallel raised ribs which traverse a portion of its width. Centrally mounted across these ribs is a center beam also preferably made of stainless steel in a U-shaped flanged configuration with the flanges thereof spot welded to the ribs. Respective longitudinal side beams of a similar metal construction are positioned abutting the ends of the ribs and include an extended flange on one side, extending from the rib end to the ends of the sheet, with a shorter flange resting on the ribs and interposed therebetween a U-shaped member. The side beams are affixed to the sheet by way of spot welding the flanges thereto, particularly at the point the shorter flange rests on the ribs, with a greater number of welds provided between the larger flange and the sheet. Mounting holes are now advantageously provided for ready coupling to mounting rods or lag bolt for affixing the panel to the wall or ceiling area to be enclosed which it is to be mounted.

BRIEF DESCRIPTION OF THE DRAWINGS

Thus by the aforenoted invention, its objects and advantages will be realized, the description of which should be taken in conjunction with the drawings, wherein:

FIG. 2 is a top plan, partially removed view of the reverse side of the panel;

FIG. 3 is a side partially sectional view of the panel taken along lines 3—3 of FIG. 2; and FIG. 4 is a side view taken along lines 4—4 of FIG. 3.

DETAILED DESCRIPTION OF THE PREFERRED EMBODIMENT

Figure 1:
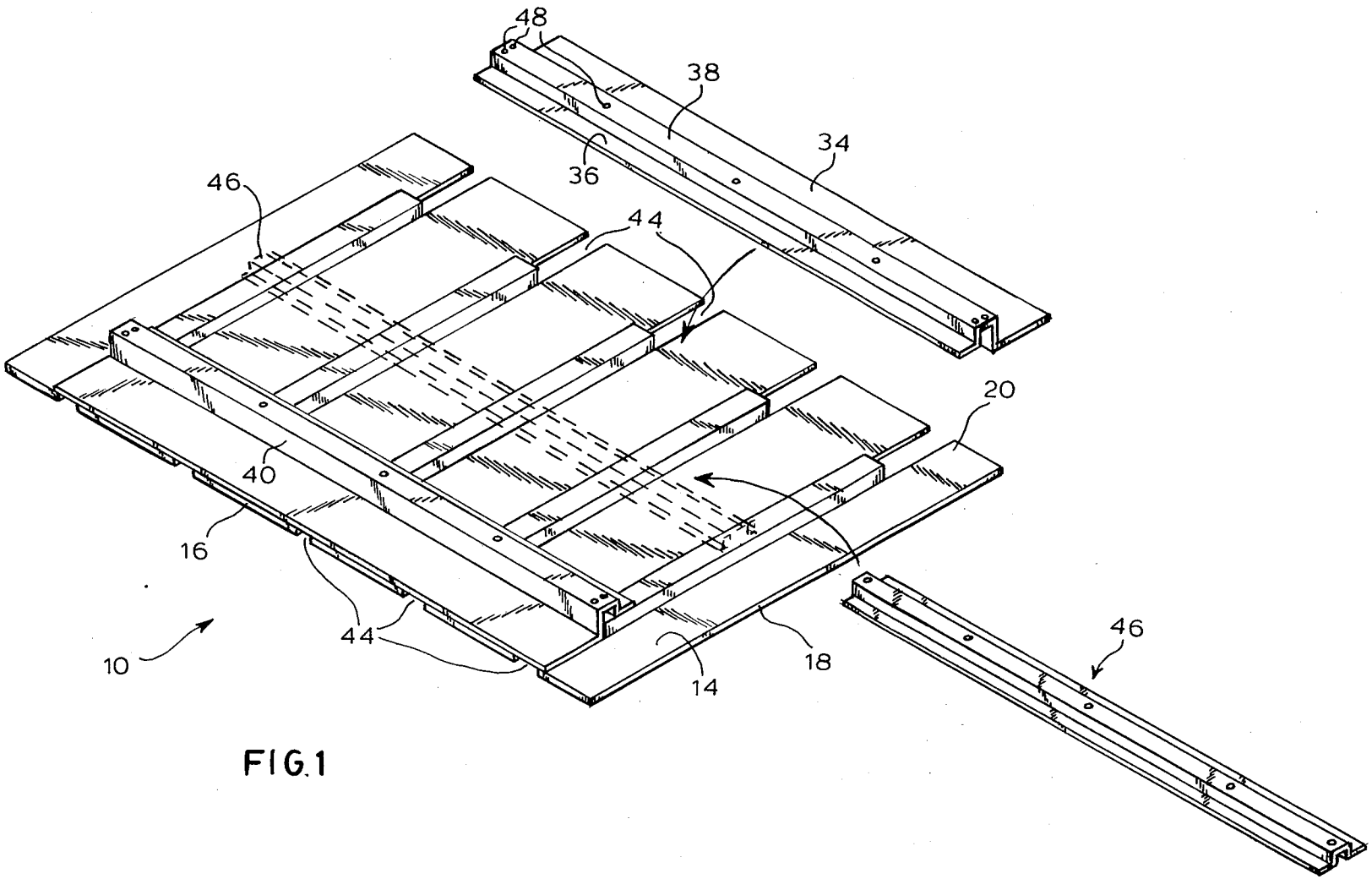
FIG. 1 is a prospective, partially detached and phantom view of the reverse side of the building panel, incorporating the teachings of the present invention.

With reference now more particularly to the drawings, there is shown a building panel 10 which is preferably fabricated out of a durable metal such as stainless steel of a desired gauge, i.e., 20 gauge type 304. The panel 10 is of a rectangular shape having a front 12 and rear surface 14 with its length and width sides respectively designated 16 and 18. Sheet 20 comprises the largest member of the panel 10 and is generally planar with the exception of a plurality of equally spaced parallel ribs 22 formed widthwise across the sheet 20 terminating at a distance D from the respective sides thereof, as can be clearly seen in FIG. 2. These ribs 22, (5 are shown) may be pressed into sheet 20 by a power brake etc. suitable for purpose and are formed with two legs 24 which angle upward to a flat portion 28 which is parallel with that of sheet 20.

The ends 30 of the respective ribs 22 are positioned on line with each other and parallel with the sides 16 of the sheet 20.

Abutting ends 30 are respective longitudinal sidebeams 32, which may be of similar metal construction and include an extended flange 34 on one side extending from the rib ends 30 to the end of the sheet 20. A shorter flange 36 is provided and rests on the flat portion 28 of the ribs. Formed therebetween and integral therewith is a somewhat U-shaped connecting member 38 having an arm 40 abutting the rib ends 30. The sidebeams 32 are preferably affixed to the sheet by way of spot welding (indicated generally by 42) flanges 34 and 36 thereto particularly at the point where flange 36 rests on the ribs 28, with a greater number of welds provided between the larger flange 34 and the sheet 20 representatively as shown. Note that not only do the sidebeams 32 obviously strengthen the panel, the larger flange 34 also serves to compensate for any creasing or loss of material on the portion of sheet which may result from the pressing procedure utilized. In particular, in forming the ribs 22 cut outs 4 are first provided on opposite sides of the panel so that formation of the ribs 22 by the power brake from the remaining transverse area of the panel does not result in barrelling or bowing due to any lateral take up of material not forming part of the ribs.

Centrally mounted across ribs 28 and between the sidebeams 32 is a center beam 46, also preferably made of a similar metal of that of the sheet 20 and formed in a U-shaped flanged configuration with the flanges thereof spot welded to the ribs 28 at the points it rests thereon.

Mounting hole 48 may now be positioned at the junctions of the sidebeams 32, center beam 46 and ribs 28 which extend through said members and allow for the ready coupling of mounting rods or lag bolts so as to secure the panel to a surface when required in certain applications, i.e., tunnel ceilings, etc. This provides for such coupling at points on the panel that are strengthened by the arrangement and avoids mounting at critical stress points.

Additional panels 20 are readily positioned abutting each other so as to create for example an entire ceiling or wall etc., without weak sections, due to the strength of the panel. In certain applications, it may be desirable to overlap portions of adjacent panels for perhaps added strength in a particular area, or to facilitate mounting etc., which can be readily accommodated due to the panels construction. Furthermore, the panel is readily fabricated and sized (typical panels are approximately 4'×8') for purpose, yet readily and securely mountable while having a pleasing asthetic appearance.

Thus by the aforenoted invention, its objects and advantages are realized and although a preferred embodiment has been disclosed and described in detail, its scope should not be limited thereby, rather its scope should be determined by that of the appended claims.

What is claimed is:

1. A building panel comprising:

flat sheet member of generally rectangular configuration having a plurality of parallel and integrally formed raised ribs positioned across a portion of said sheet and terminating in ends;

at least two side beam members located at approximately a right angle to said ribs having a first flange positioned over a portion of the respective ribs and affixed thereto and a second elongated flange affixed to the sheet beyond the ribs, interposed between said first and second flange a connecting member integral therewith having an arm thereof abutting a plurality of rib ends; and center beams positioned between said side beams and affixed to said respective ribs.

2. The panel in accordance with claim 1 wherein said connecting member is of a U-shape configuration, said center beam is of a flanged U-shape configuration and said side beam and said center member are affixed to said sheet by a plurality of welds at points along where said first flange and the flanges of the center beam rest on the respective ribs.

3. The panel in accordance with claim 2 wherein said second flange is affixed to the sheet by a plurality of equally spaced welds therebetween.

4. The panel in accordance with claim 3 wherein said ribs are formed having two legs which angle upward to a flat portion on which a portion of said side beams and center beam rest.

5. The panel in accordance with claim 4 which includes a plurality of mounting holes positioned at a plurality of points where said side beams and center beams respectively overlap said ribs.

6. The panel in accordance with claim 5 wherein said sheet member, side beams and center beams are fabricated out of stainless steel.

7. The panel in accordance with claim 1 which includes a plurality of mounting holes positioned at a plurality of points where said side beams and center beams respectively overlap said ribs.

8. The panel in accordance with claim 1 wherein said sheet member, side beams and center beams are fabricated out of stainless steel.

* * * * *